United States Patent [19]

Loretan

[11] 4,217,753

[45] Aug. 19, 1980

[54] METHOD FOR THE MANUFACTURING OF A METALLIC BUSHING FOR A BEARING OF TIMEPIECES AND OF SMALL MECHANICS AND BUSHING OBTAINED BY CARRYING OUT THIS METHOD

[75] Inventor: Edouard Loretan, Le Sentier, Switzerland

[73] Assignee: Kif-Parechoc S.A., Vaud, Switzerland

[21] Appl. No.: 970,157

[22] Filed: Dec. 18, 1978

[30] Foreign Application Priority Data

Dec. 20, 1977 [CH] Switzerland ..... 15721/77

[51] Int. Cl.[2] ..... G04B 31/00; B21D 53/10

[52] U.S. Cl. ..... 368/324; 29/177; 29/149.5 R; 113/116 V

[58] Field of Search ..... 29/177, 149.5 R, 149.5 DD, 29/149.5 C, 149.5 PM; 113/116 V, 116 BB; 58/140 R; 72/329, 330, 336; 51/164.1

[56] References Cited

U.S. PATENT DOCUMENTS

| | | | |
|---|---|---|---|
| 2,924,914 | 2/1960 | Garwood | 51/164 |
| 2,956,394 | 10/1960 | Dubois | 58/140 |
| 3,146,748 | 9/1964 | Knocke | 113/121 |
| 3,438,109 | 4/1969 | Erard | 29/149.5 |

FOREIGN PATENT DOCUMENTS

| | | | |
|---|---|---|---|
| 577201 | 6/1976 | Switzerland | 58/140 R |

*Primary Examiner*—J. V. Truhe
*Assistant Examiner*—John B. Conklin
*Attorney, Agent, or Firm*—Silverman, Cass & Singer, Ltd.

[57] ABSTRACT

A method of making a bushing and a bushing made thereby for use as the bearing of a timepiece or the like, in which a sheet of metal is stamped to form a cambered disc, a central passageway is formed in the cambered disc by stamping in a direction from the concave to the convex surface of the disc so that any burr formed will be on the convex surface, and tumbling the cambered disc in a polishing drum to remove the burr. The disc so made is adapted to accept in the central passageway and in a direction from the concave to the convex surface a rotating shaft to be journalled therein so that any burr remaining at the convex surface is folded away from the central passageway when the shaft is engaged therein.

5 Claims, 3 Drawing Figures

METHOD FOR THE MANUFACTURING OF A METALLIC BUSHING FOR A BEARING OF TIMEPIECES AND OF SMALL MECHANICS AND BUSHING OBTAINED BY CARRYING OUT THIS METHOD

BACKGROUND OF THE INVENTION

The present invention relates to a method for manufacturing a metallic bushing for a bearing of timepieces and of small mechanical devices.

The invention relates also to the bushing obtained by carrying out this method.

Bushings of bearings for timepieces and for small mechanical apparatus obtained by turning on a lathe and drilling are known. They are constituted by a relatively thin plane metallic washer. These bushings show the drawback of being expensive in their manufacturing.

The purpose of the present invention is to supply a method of manufacturing of such bushings which is cheap or inexpensive while nevertheless conducing to a product of quality.

SUMMARY OF THE INVENTION

To this effect, the method according to the invention is characterized by the fact that one gives a cambered form to the bushing or disc, by a cutting or stamping operation and polishes in a drum the element thus obtained.

The bushing, being cambered, shows a convex face which has a supplementary advantage of better retaining oil in the bearing.

BRIEF DESCRIPTION OF THE DRAWING

The drawing shows, by way of example, one embodiment of the invention and a modification thereof.

DESCRIPTION OF THE PREFERRED EMBODIMENT

Figure 1:
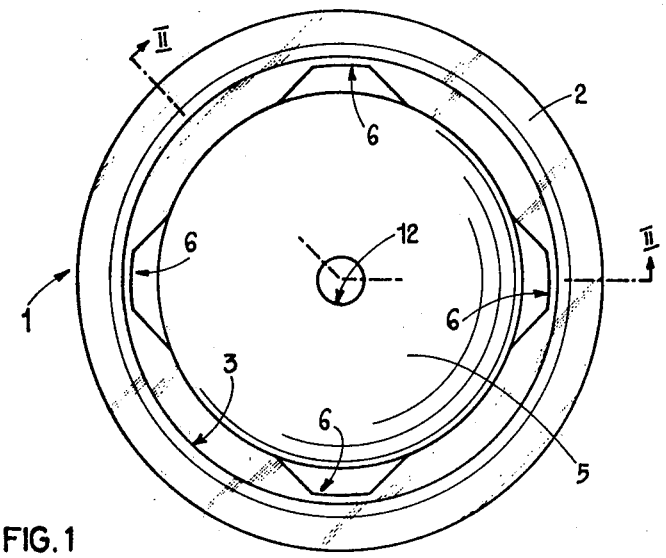
FIG. 1 is a plan view of a part of a shock absorbing bearing for a timepiece or for a small mechanical apparatus, an element of this bushing being suppressed.
Figure 2:
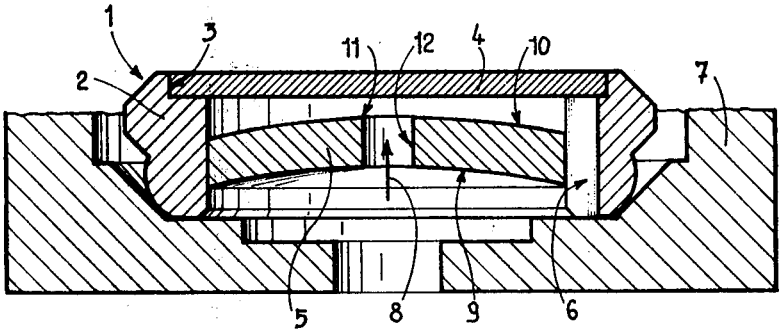
FIG. 2 is a sectional view along line II—II of FIG. 1.

The bushing represented in FIGS. 1 and 2 is entirely metallic, comprises a bearing body, generally designated by 1, constituted by a setting 2, in a recess 3 of which is forced an endpiece 4. Endpiece 4 has been suppressed in FIG. 1 for increasing the clearness of the drawing. A bushing 5, of convex shape, constituted by a cambered washer or disc, is forced in the setting 2.

Longitudinal grooves 6, realized by means of an expander of square section, are provided in the wall of the central hole of the setting 2 for permitting the cleaning of the bearing by means of a cleaning liquid the bearing body 1 not being intended to be dismounted.

The bearing body 1 bears on a bearing support 7, partially represented in FIG. 2, in which it is returned into its central position by a not represented spring.

The cambered washer 5 constituting the bushing is obtained by a cutting or stamping operation which is effected on a blank made of sheet-shaped material in the direction indicated by an arrow 8 of FIG. 2. That is to say that the cutting or stamping operation goes from the face 9 of a blank which is intended to become concave towards a face 10 which is intended to become convex.

Owing to this way or direction of operating by cutting or stamping, the burr which could be formed at 11, around the central hole or passageway 12 of the bushing 5, can easily be eliminated by a polishing operation in a drum, to which the cambered washer is submitted. Moreover, if a trace of burr would subsist at 11, there is no risk of the burr being folded back towards the inner of the hole 12 when a shaft is engaged therein because the burr is situated on the outer face of the bushing.

It is to be noted that the wall of the hole 12 does not have to be polished after the operation of cutting or stamping which gives it directly a suitable surface state. So far as the faces of the washer 5 are concerned, it is the outer face which almost always must be polished since it is this face which maintains the oil in the bearing. Now, this face being convex, it is thereon that the drum polishing acts the most efficiently.

Figure 3:
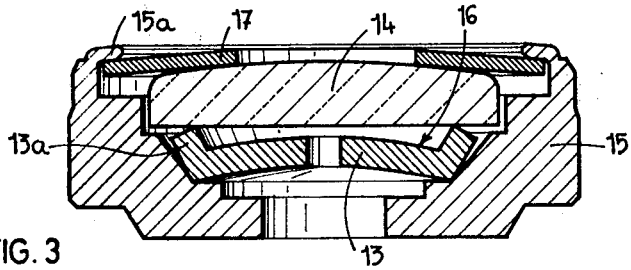
FIG. 3 is an axial sectional view of a modification of the invention.

The modification of FIG. 3 distinguishes from the first embodiment by the fact that the bearing does not comprise any bearing body as in the first embodiment, the bushing, designated by 13, as well as the endpiece, designated by 14, being directly located in the bearing support 15. Moreover, the bushing is provided with a pheriperal edge **13*a* of frusto-conical shape, which makes a protrusion on its outer convex face 16, by which the endpiece 14, returned by a spring 17 hooked to an edge 15*a*** of the bearing support, bears on the bushing.

The bushing, which is metallic, is constituted by a cambered washer obtained by a cutting-stamping operation, as in the first embodiment, on a blank made of sheet-shaped material which is then submitted to a drum polishing operation.

It is to be noted that the invention can be applied as well to stationary bearings for watch-making and small mechanical apparatus, as to shock absorbing bearings.

What I claim is:

1. A method of making a metallic bushing for use as the bearing of a timepiece or the like, the bushing comprising a thin cambered disc having a central passageway for receiving in a direction from the concave surface of the cambered disc to the convex surface of the cambered disc a rotating shaft to be journalled therein, said method comprising:

A. stamping the disc from sheet metal and forming the camber during the stamping process;

B. piercing the passageway by stamping in a direction from the concave surface of the disc to the convex surface of the disc so that any burr formed will be formed on the convex surface; and C. tumbling the disc in a polishing drum to remove the burr.

2. The method as claimed in claim 1 in which the steps of stamping the disc and piercing the passageway are performed simultaneously.

3. A metallic bushing for use as the bearing of a timepiece or the like, the bushing comprising:

a thin cambered disc having a central passageway for receiving in a direction from the concave surface of the disc to the convex surface of the disc a rotating shaft to be journalled therein, the disc being formed from a sheet of metal by stamping with the camber of the disc being formed during the stamping of the disc, the passageway being pierced by stamping from the concave surface of the disc to the convex surface of the disc so that any burr formed will be on the convex surface, and the disc being tumbled in a polishing drum to remove the burr.

4. The bushing as claimed in claim 3 in which the cambered disc includes a peripheral edge protruding from the convex surface of the disc.

5. The bushing as claimed in claim 4 in which the peripheral edge is of frusto-conical shape.

* * * * *